United States Patent [19]

Lawrence et al.

[11] Patent Number: 4,740,783

[45] Date of Patent: Apr. 26, 1988

[54] VISUAL DISPLAY UNIT WITH CHARACTER OVERSTRIKE

[75] Inventors: Stephen G. C. Lawrence, Southampton; Brian H. Middleton, Hants, both of United Kingdom

[73] Assignee: International Business Machines Corporation, Armonk, N.Y.

[21] Appl. No.: 794,900

[22] Filed: Nov. 4, 1985

[30] Foreign Application Priority Data

Apr. 26, 1985 [EP] European Pat. Off. ..... 85302952.8

[51] Int. Cl.[4] ..... G09G 1/14

[52] U.S. Cl. ..... 340/720; 340/735; 340/748; 340/790

[58] Field of Search ..... 340/720, 721, 735, 745, 340/750, 790, 748

[56] References Cited

U.S. PATENT DOCUMENTS

| | | | |
|---|---|---|---|
| 4,204,208 | 5/1980 | McCarthy | 340/745 |
| 4,443,794 | 4/1984 | Sakurai | 340/735 |
| 4,464,730 | 8/1984 | Lawrence et al. | 364/900 |
| 4,584,573 | 4/1986 | Ito | 340/721 |
| 4,600,920 | 7/1986 | Makita | 340/735 |
| 4,603,330 | 7/1986 | Horne et al. | 340/735 |

FOREIGN PATENT DOCUMENTS

| | | | |
|---|---|---|---|
| 0044667 | 7/1981 | European Pat. Off. . | |
| 0102750 | 7/1983 | European Pat. Off. . | |
| 3026566 | 7/1980 | Fed. Rep. of Germany . | |
| 0120553 | 9/1979 | Japan | 340/721 |

*Primary Examiner*—Marshall M. Curtis
*Assistant Examiner*—Mahmoud Fatahi-Yar
*Attorney, Agent, or Firm*—Douglas H. Lefeve

[57] ABSTRACT

A visual display unit with character overstrike capability includes a text store in which text is stored in data stream form. A formatter formats the stored text and loads character codes into a refresh buffer which together with a character generator display the characters on a raster scanned cathode ray tube. Control logic responsive to a backspace character combines the bit patterns corresponding to the characters preceding and succeeding the backspace character in a temporary store and then stores the composite bit pattern in the character generator and a pointer thereto in the refresh buffer. The control logic can be inhibited to allow the individual characters constituting the composite character to be displayed individually for editing purposes.

4 Claims, 1 Drawing Sheet

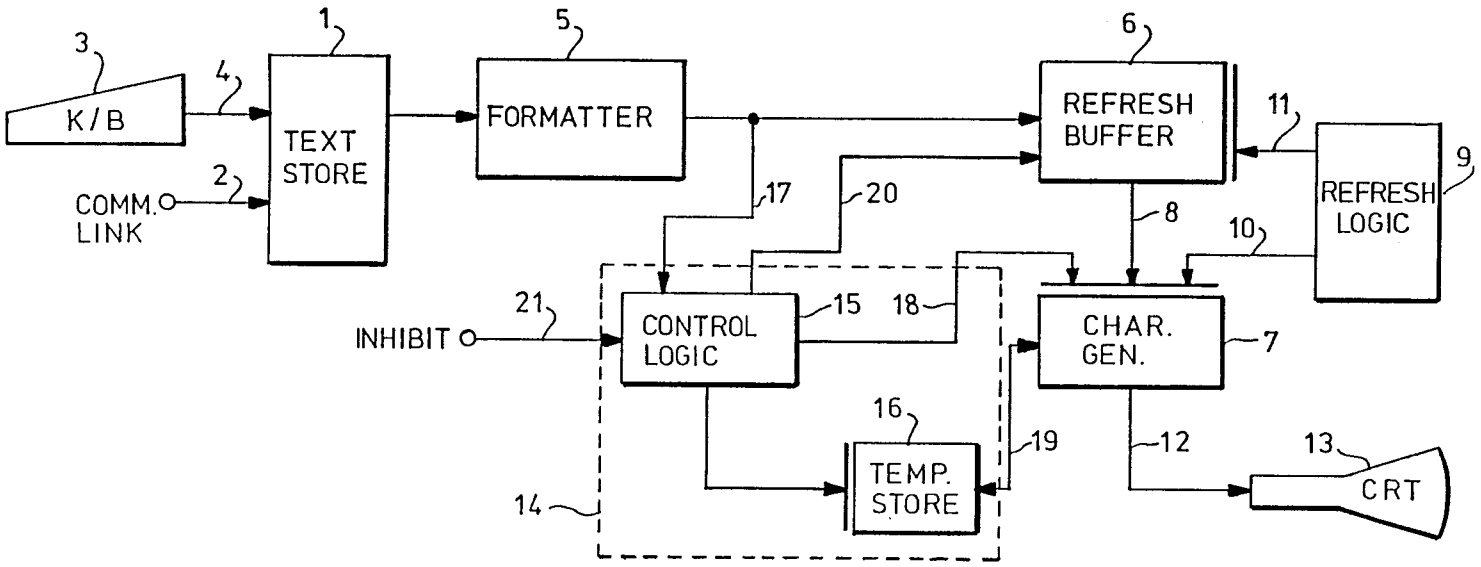
K/B
3
4
COMM.
LINK
2
TEXT
STORE
1
FORMATTER
5
REFRESH
BUFFER
6
11
REFRESH
LOGIC
9
10
8
CHAR.
GEN.
7
12
CRT
13
INHIBIT
21
CONTROL
LOGIC
15
17
20
18
19
TEMP.
STORE
16
14

VISUAL DISPLAY UNIT WITH CHARACTER OVERSTRIKE

TECHNICAL FIELD

The present invention relates to a visual display unit provided with a means to allow composite characters to be displayed thereon by means of character overstrike.

BACKGROUND ART

(PRIOR ART STATEMENT)

As will be familiar to those having some knowledge of typewriters, it is possible with a typewriter to "print" a composite character made up of at least two other characters. This would normally be done by depressing one character key, backspacing and then depressing the second character key. Sometimes, with accented characters, the accent key is a so-called dead key so that to produce the composite accented character, it is only necessary to depress the accent key followed by the character key; but frequently it is necessary to backspace to produce an accented character. This production of composite characters is known as character overstrike.

There is a similar need to allow composite characters to be displayed on visual display units. Visual display units (VDUs) fall into two main types, one, such as that on the IBM 3270 PC/GX, in which characters are presented on a viewing screen by addressing an all points addressable refresh memory into which a bit pattern representing the character to be displayed is written, and a second type, such as that on the IBM 3277, 3278, 3279 and 8775, in which use is made of a coded character store containing coded representations of the various characters which can be displayed and a character generator which contains the actual bit pattern for those characters. The second type has the advantage that the bit patterns need be stored only once for each character code, no matter how many times that character needs to be displayed. Typically the character generator will consist of a read only memory, although a writable character generator store will allow different character sets to be loaded into the character generator. The display of the IBM 3270 PC/G has both a coded character refresh buffer and an all points addressable refresh buffer, and although the former is normally used for the display of alphanumeric characters, alphanumeric characters can also be displayed using the all points addressable refresh buffer in which case a composite character could also be displayed.

However it is not easy to display an overstruck composite character on a visual display unit of the type employing only a coded character refresh buffer in conjunction with a character generator.

U.S. Pat. No. 4,204,208 describes an arrangement in which two character generators are used with the ability to mix the bit pattern from one character generator with the bit pattern from the other character generator to produce a composite overlaid character. However such an arrangement is complex and does not readily lend itself to the situation in which the text is stored in the form "character 1", "back space", "character 2". As is explained in U.S. Pat. No. 4,464,730 text is conveniently stored in linear text stream form, with a formatter being utilized to read the sequentially stored text to load a cathode ray tube refresh buffer with appropriate character codes.

DISCLOSURE OF THE INVENTION

An object of the present invention is to provide an arrangement in which a visual display station storing text in text stream format and employing a coded character refresh buffer can cause a composite character to be displayed.

According to the invention, a visual display unit comprises a text store for containing text comprising alphanumeric characters and other symbols in data stream form, formatting means for formatting text stored in the store and loading character codes into a refresh buffer, a character generator addressable by the refresh buffer for containing bit patterns corresponding to characters and symbols to be displayed, a raster scanned cathode ray tube, and refresh logic for periodically refreshing the cathode ray tube by periodically causing the refresh buffer to access the character generator. The invention is further characterized by control logic operable upon detection of a backspace character to cause the bit pattern corresponding to the preceding character in the data stream to be stored in a temporary store and to combine therewith the bit pattern corresponding to the character next succeeding the backspace character. The control logic is thereafter operable to store the composite bit pattern within the character generator and to store in the refresh buffer a pointer to the stored composite bit pattern.

The invention will now be particularly described, by way of example, with reference to the accompanying drawings.

BRIEF DESCRIPTION OF DRAWING

The FIGURE is a block schematic showing the main parts of a preferred embodiment of the invention.

BEST MODE FOR CARRYING OUT THE INVENTION

Referring now to the drawing, a visual display unit includes a text store 1 in which alphanumeric characters and other symbols are stored sequentially in data stream format. Although this requires the characters to be stored in a logical sequence, they need not occupy physically contiguous storage space. The text stored in store 1 is either received over a communication link from a remote source or entered locally from a keyboard 3 via line 4 by an operator.

As indicated above, there is a need to create certain composite characters, for example to create accented characters or symbols representing yen (¥) and dollars ($) where such symbols are not provided as part of the character set. Within the store 1, such composite characters as "¥" and "$" would be stored as "Y", "backspace", "=" and "S", "backspace", "/", respectively.

In legal draft documents it is necessary to display text which is to be excised as well as the new, revised text. Preferably the text in the text store 1 is stored in data stream code form but if convenient it could be stored in any other coded form. Typical code forms include ASCII, EBCDIC and SCS (System Network Architecture Character Set). As well as codes representing characters and other symbols, the text may contain text command codes which, as explained in U.S. Pat. No. 4,464,730 can be single character commands such as "backspace" or extended formatting commands such as page width commands. In its simplest form, in which the text does not contain extending formatting commands, the formatter will merely be converting character codes into another code form.

Formatter 5, which may be constituted by hard-wire logic or whose function may be performed by a suitably programmed microprocessor, inspects stored text within the text store 1, formats it and loads appropriate character codes into a refresh buffer 6 which will thus contain codes representing the characters to be displayed on a visual display unit. The character codes within the buffer 6 are of different form to the codes stored in the store 1 and serve as pointers to a character generator 7, along address lines 8, which contains the bit patterns required to display the desired characters. It will be appreciated that each character is formed as a series of slices corresponding to raster scan lines and that the character generator 7 will need to be addressed by a slice counter as well as the refresh buffer 6. However, since this detail of description is not required for an understanding of the present invention, and in the interests of simplicity of description, no further description will be made of the character generator 7 or the way it is addressed during refresh.

Operation of the character generator 7 and the refresh buffer 6 is controlled by refresh logic 9, timing control line 10 and address line 11 to produce a series of bits on line 12 corresponding to the picture elements (pels) to be displayed in the raster scanned cathode ray tube 13. As described thus far, the visual display unit is similar to that described in U.S. Pat. No. 4,464,730 and the IBM 8775 and 3270 PC/G display stations.

Unit 14 enables the display unit to display composite characters. Unit 14 includes control logic 15 and a small temporary store 16. In use, character codes being mapped to the refresh buffer 6 by formatter 5 are inspected, via line 17 by the control logic 15.

There is no effect on normal operation until a "backspace character" is detected by the control logic 15. Upon detection of a "backspace character", control logic 15 accesses the character generator 7 over address line 18 to obtain the bit pattern corresponding to the character immediately preceding the "backspace character" and whose character code or pointer will already by stored in the refresh buffer 6. The bit pattern is stored, via line 19, in the temporary store 16. After the "backspace character" has been so processed by the control logic 15, the next character will be the overstrike character. Its bit pattern is obtained from the character generator 7 and is ORed into the bit pattern already stored in the temporary store to create a new bit pattern corresponding to the overstruck or composite character. The composite bit pattern is stored within the character generator 7 along line 19 and the pointer to that bit pattern is stored along line 20 into the refresh buffer 6, overwriting the originally stored character code.

Clearly this implies that the character generator 7 includes a read/write memory and cannot be of the type which includes only a read-only memory. Those skilled in the art will appreciate that although the text store 1, refresh buffer 6 and temporary store 16 are shown as separate units, they could in practice be constituted by separate parts of a single random access memory. Similarly the temporary store 16 and the character generator 7 memory could be part of the same memory except that the temporary store 16 would not be addressable by the refresh buffer 6.

It will be apparent that more than two characters can be combined in this manner.

During editing of text, it is helpful if the individual characters which constitute a composite character can be displayed. To this end, in a preferred embodiment the control logic 15 can be inhibited by means of inhibit line 21 so that the three (or more) separate characters will be displayed in the normal manner by writing the three (or more) pointers into the refresh buffer 6.

The control logic 15 can be constructed from hard-wired logic, i.e., from appropriate logic gates, or it can be constituted by a suitably programmed microprocessor. Any competent logic designer or programmer can implement the logic 15 using the following flow chart in the form shown in Table A.

TABLE A

| | |
|---|---|
| Step a. | Fetch next "character" from text store 1. |
| Step b. | If control logic 15 inhibited go to step e; if not go to step c. |
| Step c. | If "preceding character" is backspace go to step f; if not go to step d. |
| Step d. | If "character" is backspace go to step g; if not go to step e. |
| Step e. | Load pointer into next position in refresh buffer 6 and return to step a. |
| Step f. | Cause control logic 15 to load corresponding bit pattern into temporary store 16 to produce combined bit pattern, load combined bit pattern from temporary store 16 into character generator 7, replace last-entered pointer in refresh buffer 6 with new pointer and return to step a. |
| Step g. | Load bit pattern corresponding to previous character into temporary store and return to step a. |

While the invention has been shown and described with reference to particular embodiments thereof, it will be understood by those skilled in the art that the foregoing and other changes in form and details may be made therein without departing from the spirit and scope of the invention.

What is claimed is:

1. A method of displaying composite codes in a display system which receives a data stream of alphanumeric codes and control codes, comprising:

formatting said data stream into one or more lines of said codes for storing said codes in a refresh buffer to address a character generator to send pel patterns representing said codes directly to a visual display;

detecting a backspace control code in said data stream;

storing, at a first address of a temporary store, the pel pattern of an alphanumeric character immediately preceding said backspace control code;

storing, at said first address of said temporary store, the pel pattern of an alphanumeric character immediately succeeding said backspace control code;

loading the contents of said first address of said temporary store into a second address of a random access memory portion of said character generator;

replacing, in said refresh buffer, said alphanumeric code immediately preceding said backspace code with a pointer to said second address of said random access memory portion of said character generator and;

inhibiting the response by said refresh buffer and said character generator to said backspace control code and said alphanumeric character immediately succeeding said backspace control code, whereby the content of said random access memory portion of said character generator is displayed.

2. The method of claim 1, further comprising:

inhibiting the replacing, in said refresh buffer, said alphanumeric code immediately preceding said backspace control code with said pointer, whereby the individual pel patterns which form a composite character can be individually displayed on said visual display.

3. A display system for displaying composite codes in which said display system receives a data stream of alphanumeric codes and control codes, comprising:

means for formatting said data stream into one or more lines of said codes for storing said codes in a refresh buffer to address a character generator to send pel patterns representing said codes directly to a visual display;

control logic means connected to said means for formatting for detecting a backspace control code in said data stream;

temporary store means connected to said control logic means for storing, at a first address of said temporary store, the pel patterns of the alphanumeric characters immediately preceding and succeeding said backspace control code;

said control logic means including means for loading the contents of said first address of said temporary store into a second address of a random access memory portion of said character generator;

said control logic means including means for replacing, in said refresh buffer, said alphanumeric code immediately preceding said backspace code with a pointer to said second address of said random access memory portion of said character generator; and said control logic means including means for inhibiting the response by said refresh buffer and said character generator to said backspace control code and said alphanumeric character immediately succeeding said backspace control code, whereby the content of said random access memory portion of said character generator is displayed.

4. The system of claim 3, wherein said control logic means further comprises:

means for inhibiting the replacing, in said refresh buffer, said alphanumeric code immediately preceding said backspace control code with said pointer, whereby the individual pel patterns which form a composite character can be individually displayed on said visual display.

* * * * *